US006493455B1

(12) United States Patent
Tracy

(10) Patent No.: US 6,493,455 B1
(45) Date of Patent: Dec. 10, 2002

(54) SUBWOOFER ASSEMBLY

(76) Inventor: Dennis A. Tracy, 11136 Washington Blvd., Culver City, CA (US) 90232

( * ) Notice: Subject to any disclaimer, the term of this patent is extended or adjusted under 35 U.S.C. 154(b) by 53 days.

(21) Appl. No.: 09/585,273

(22) Filed: Jun. 2, 2000

Related U.S. Application Data

(60) Provisional application No. 60/137,793, filed on Jun. 3, 1999.

(51) Int. Cl.[7] ..... H04R 25/00

(52) U.S. Cl. ..... 381/345; 381/350

(58) Field of Search ..... 381/345, 349, 381/350, 351, 87, 332, 335; 181/155, 156

(56) References Cited

U.S. PATENT DOCUMENTS 1,969,704 A * 8/1934 D'Alton ..... 181/160
3,688,864 A * 9/1972 Guss ..... 181/145
4,006,308 A * 2/1977 Ponsgen ..... 181/147
4,356,881 A * 11/1982 Lowell ..... 181/150
4,549,631 A * 10/1985 Bose ..... 181/155
4,714,133 A * 12/1987 Skaggs, Jr. ..... 181/148
4,875,546 A * 10/1989 Krnan ..... 181/144
4,932,060 A * 6/1990 Schreiber ..... 181/145
4,944,019 A * 7/1990 Watanabe ..... 181/145
5,025,885 A * 6/1991 Froeschle ..... 181/144
5,092,424 A * 3/1992 Schreiber et al. ..... 181/145
5,629,582 A * 5/1997 Nakano ..... 181/145
5,657,392 A * 8/1997 Bouchard ..... 181/145
5,659,157 A * 8/1997 Schulte ..... 181/156
5,701,359 A * 12/1997 Guenther et al. ..... 181/157
5,731,553 A * 3/1998 Ledoux ..... 181/151
6,223,853 B1 * 5/2001 Huon et al. ..... 181/145
6,237,715 B1 * 5/2001 Tracy ..... 181/141

* cited by examiner

*Primary Examiner*—Curtis Kuntz
*Assistant Examiner*—P. Dabney
(74) *Attorney, Agent, or Firm*—Welsh & Flaxman LLC

(57) ABSTRACT

The invention relates to a loudspeaker assembly including a housing having a central driver mounting plate upon which a driver is mounted. The central driver mounting plate and the driver divide the housing into an upper compartment and a lower compartment, wherein the lower compartment includes at least one slot providing fluid communication between an interior of the lower compartment and an external environment.

14 Claims, 4 Drawing Sheets

SUBWOOFER ASSEMBLY

CROSS-REFERENCE TO RELATED APPLICATIONS

This U.S. Patent Application is based upon U.S. Provisional Patent Application Serial No. 60/137,793, filed Jun. 3, 1999, and entitled "SUBWOOFER ASSEMBLY".

BACKGROUND OF THE INVENTION

1. Field of the Invention

The invention relates to a subwoofer assembly. More particularly, the present invention relates to a low profile subwoofer assembly shaped and dimensioned for mounting adjacent the floor under an aircraft seat, behind a divan, below a drink rail or between adjacent windows.

2. Description of the Prior Art

The current global community has made it possible for people from around the country, and around the world, to interact for both business and personal reasons. For many people, this requires that they spend considerable time traveling from one location to another location. More often than not, these people travel in aircrafts.

Whether these people travel in private or commercial aircrafts, they desire high quality entertainment during the many hours they spend within the confines of an aircraft. However, while high quality entertainment, for example, digital video with CD quality sound, is readily available for theater and home use, the weight and size requirements for use in aircrafts make it very difficult to incorporate high fidelity systems within an aircraft. This problem is especially pronounced for audio speaker assemblies when one attempts to meet the size, weight and shape requirements for use in aircrafts.

In the aircraft industry great priority is placed upon component weight and size reduction. In addition, spacing and positioning of the speaker assemblies is a great priority to those optimizing the operation of aircrafts. The size, weight and shape of conventional terrestrial speaker assembly designs adversely affect range and payload. These concerns are notable when one attempts to make changes within smaller private jets. For example, a small increase in the weight carried by an aircraft results in a substantial increase in the fuel consumption of the aircraft. In addition, the limited space available within an aircraft dictates the use of any space within the aircraft be carefully considered by those responsible for ensuring the comfort of passengers.

Lightweight and compact audio speakers are currently available. These speakers, however, substantially compromise sound quality for reductions in size and weight. An individual wishing to add an audio system to an aircraft must make a choice between high fidelity speakers not suiting the size and weight requirements of the aircraft and lower quality speakers providing desirable size and weight characteristics.

The weight and size problems associated with the use of loudspeaker systems within aircraft is very evident when one attempts to incorporate woofers into an aircraft design. Conventional woofers employ substantial housings designed to control the manner in which sound is transmitted from the woofer. The controlled porting of sound employed in conventional woofers necessitates the construction of rather substantial housings. These housings, while controlling the transmission of sound as desired, are commonly beyond the size and weight constraints required for use within an aircraft.

A need, therefore, exists for a speaker assembly providing high fidelity sound, while also meeting the size and weight requirements of an aircraft. The present invention provides such a speaker assembly.

SUMMARY OF THE INVENTION

It is, therefore, an object of the present invention to provide a loudspeaker assembly including a housing having a central driver mounting plate upon which a driver is mounted. The central driver mounting plate and the driver divide the housing into an upper compartment and a lower compartment, wherein the lower compartment includes at least one slot providing fluid communication between an interior of the lower compartment and an external environment.

It is also an object of the present invention to provide a loudspeaker assembly wherein the housing is made of a material which will resonate to transmit sound from within the housing.

It is another object of the present invention to provide a loudspeaker assembly wherein the housing is made of aluminum.

It is a further object of the present invention to provide a loudspeaker assembly wherein the housing is made of aluminum honeycomb sheet material.

It is yet another object of the present invention to provide a loudspeaker assembly wherein the aluminum honeycomb sheet material has a thickness of approximately ¼ inch.

It is still a further object of the present invention to provide a loudspeaker assembly wherein the housing is composed of a cover plate with a plurality of side walls extending therefrom to form an enclosure with an open end. The central driver mounting plate and the driver are secured within the enclosure to divide the housing into an upper compartment and a lower compartment wherein the lower compartment is defined by the plurality of side walls and the open end of the enclosure.

It is also another object of the present invention to provide a loudspeaker assembly wherein the at least one slot is formed in the plurality of side walls providing fluid communication between an interior of the lower compartment and an external environment when the loudspeaker is mounted to cover the open end of the enclosure.

It is a further object of the present invention to provide a loudspeaker assembly wherein the driver is a low frequency driver.

It is also an object of the present invention to provide a loudspeaker assembly wherein the driver is positioned to fire into the lower compartment of the housing with a convex portion of the driver extending into the upper compartment of the housing.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
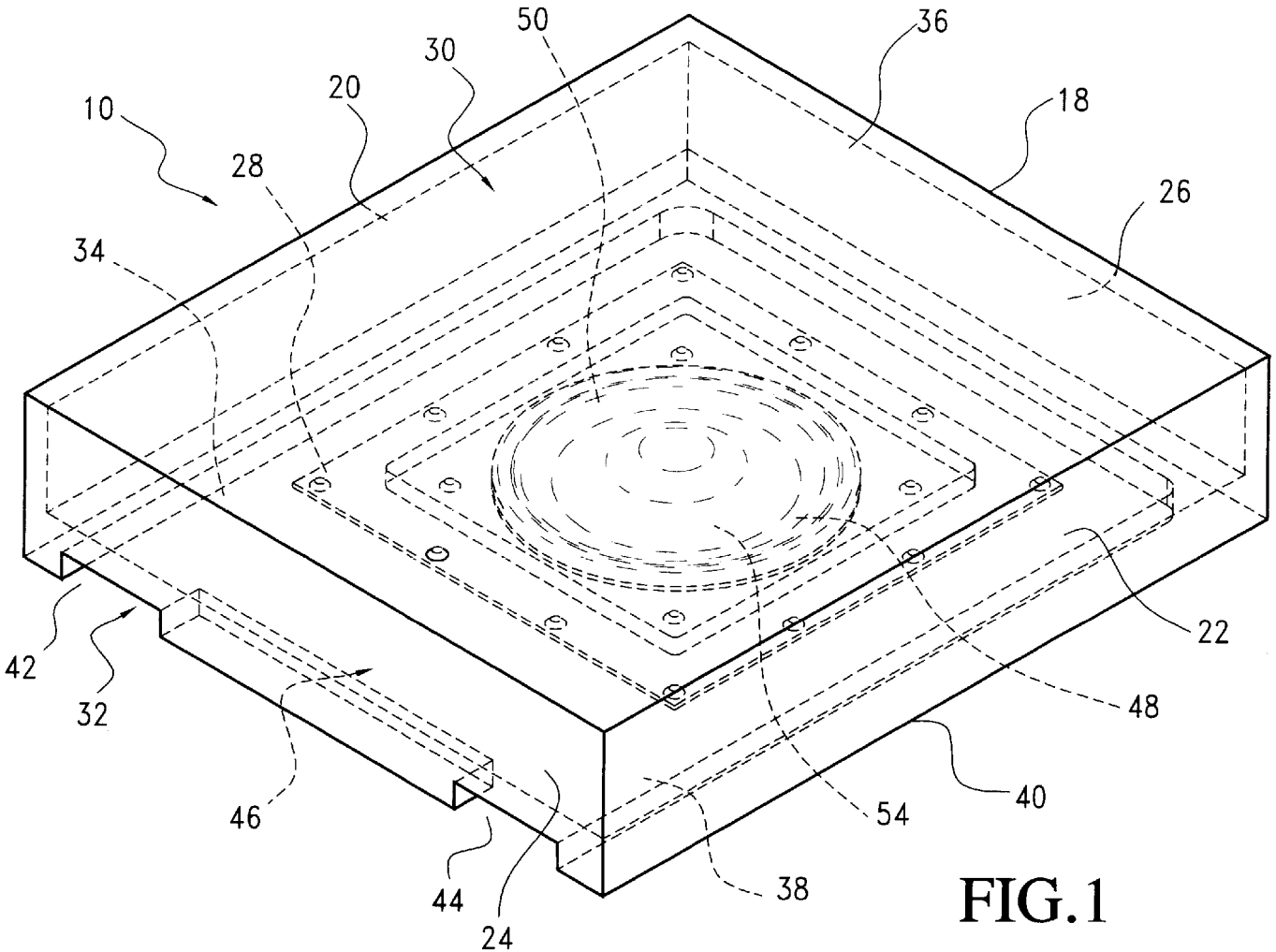
FIG. 1 is a perspective view of the present subwoofer module showing the internal components.

With reference to FIG. 1, a subwoofer module 10 in accordance with the present invention is disclosed. The subwoofer module 10 is particularly designed for use within an aircraft 12, although the subwoofer module 10 may be used in various other environments without departing from the spirit of the present invention. The present subwoofer module 10 is particularly designed for horizontal positioning on the floor 14 under an aircraft seat 16. The subwoofer module 10 is also designed for vertical mounting within an aircraft 12. For example, the present subwoofer module 10 may be mounted behind a divan, below a drink rail or between adjacent windows of an aircraft.

The present subwoofer module 10 includes a substantially rectangular housing 18. The housing 18 is preferably manufactured from aluminum. More specifically, the housing is preferably manufactured from a ¼" inch thick aluminum honeycomb sheet material. While preferred materials are disclosed in accordance with a preferred embodiment of the present invention, other materials may be used without departing from the spirit of the present invention. Regardless of the material used in the construction of the housing 18, the chosen material should resonate in a manner transmitting sound from the interior of the housing. The mechanism by which the housing 18 functions as a transducer in the transmission of sound is discussed below in greater detail.

The housing 18 is composed of lateral side walls 20, 22, a front side wall 24 and a rear side wall 26. A central driver mounting plate 28 is secured to the side walls of the housing 18 and divides the housing 18 into an upper compartment 30 and a lower compartment 32. Specifically, the upper compartment 30 is defined by the upper surface 34 of the driver mounting plate 28, the side walls 20–26 and a cover plate 36. The lower compartment 32 is defined by the lower surface 38 of the driver mounting plate 28 and side walls 20–26, while the bottom 40 of the housing 18 remains open to be ultimately closed off when the subwoofer module 10 is mounted to the floor 14 in the manner discussed below in greater detail.

The lower compartment 32 of the front side wall 24 is provided with two slots 42, 44 positioned on opposite sides of the front side wall 24. The slots 42, 44 provide fluid communication between the interior 46 of the lower compartment 32 and the external environment when the subwoofer module 10 is mounted to the floor 14 beneath an aircraft seat 16.

A low frequency driver 48 is mounted to the driver mounting plate 28. The driver 48 is positioned to fire into the lower compartment 32 of the housing 18 with the convex portion 50 of the driver 48 extending into the upper compartment 30 of the housing 18.

Figure 2:
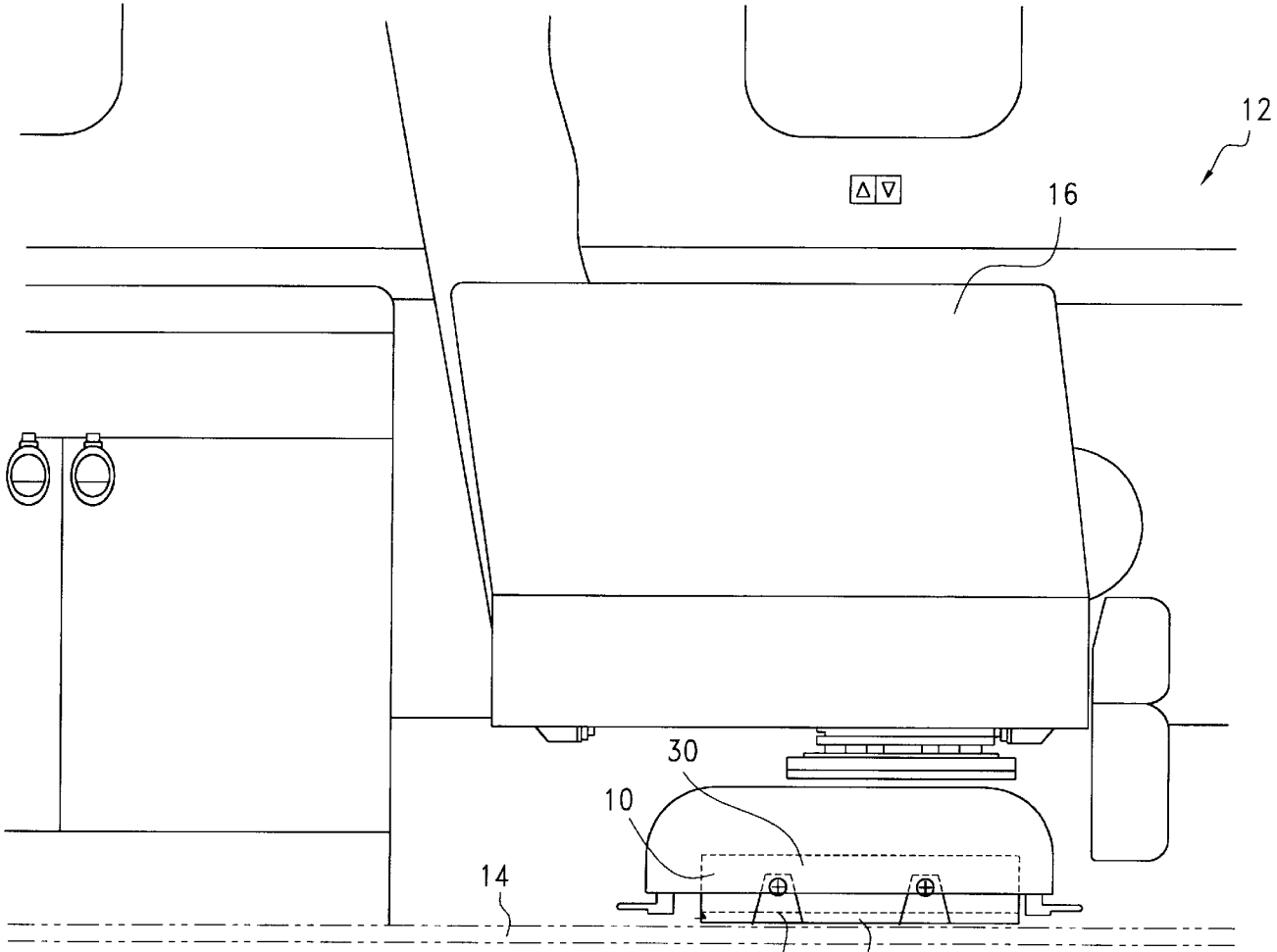
FIG. 2 is a partial cross section view of the present subwoofer module mounted beneath an aircraft seat.

In use, and with reference to FIG. 2, the present subwoofer module 10 is ideally designed for mounting to the floor 14 beneath an aircraft seat 16. Specifically, brackets 52 bolt the subwoofer module 10 to the floor 14 beneath an aircraft seat 16 with the lower compartment 32 facing downwardly and the bottom 40 of the housing 18 contacting the floor 14 of the aircraft 12 to substantially seal the lower compartment 32 (with the exception of the two slots 42, 44). In this way, the lower compartment 32 of the housing 18 becomes a sealed enclosure with a pair of slots 42, 44 permitting the passage of forced air and waves from within the lower compartment 32 of the housing 18. Additional sound is transmitted from the housing 18 which resonates in the manner discussed above to generate sound as desired.

Mounting the present subwoofer module 10 in this manner presents further advantages improving the sound generated by the properly mounted subwoofer module 10. For example, the creation of a partially enclosed-lower compartment 32, including two slots 42, 44 along the front side wall 24 of the housing 18, reduces possible excursions ($X_{max}$) of the driver 48 by physically damping the movement of the driver cone 54 with progressively greater pressure on the driver cone 54. That is, because the driver cone 54 moves within the confined space defined by the lower compartment 32, pressure is generated as the driver cone 54 moves closer to the surface upon which the subwoofer module 10 is mounted. The pressure increases in such a way that the generated pressure prevents further movement of the driver cone 54.

The reduction and control of the possible excursion of the driver 48 eliminate cone chirp which results when the driver cone 54 moves beyond $X_{max}$. With this in mind, the slots 42, 44 and the relative position of the driver 48 with respect to the floor 14 may be tuned to enhance the efficiency of the present subwoofer design, thus essentially resulting in a "ground effect".

In addition, the controlled excursion of the driver cone 54 enhances the sound resonating from the housing itself to produce a full low frequency sound from an enclosure substantially smaller and lighter than woofers found in the prior art.

By using the floor 14 of the aircraft 12 to form a wall of the lower compartment 32 of the housing 18, substantial weight savings are realized. In accordance with the preferred embodiment of the present invention, use of the floor 14 in completing the lower compartment 32 results in a substantial weight savings. While a simple plate in a housing may appear to represent only a small amount of weight, any weight reduction within an aircraft is considered to be a substantial benefit.

As previously discussed, and with reference to FIGS. 3 and 4, the present subwoofer module 10 may also be vertically mounted behind a divan, below a drink rail or between adjacent windows of the aircraft. When the subwoofer is mounted in this manner, the two slots 42, 44 located in the front side wall 24 are not necessary and it is more desirable that the lower compartment 32 include four fully closed side walls.

Figure 3:
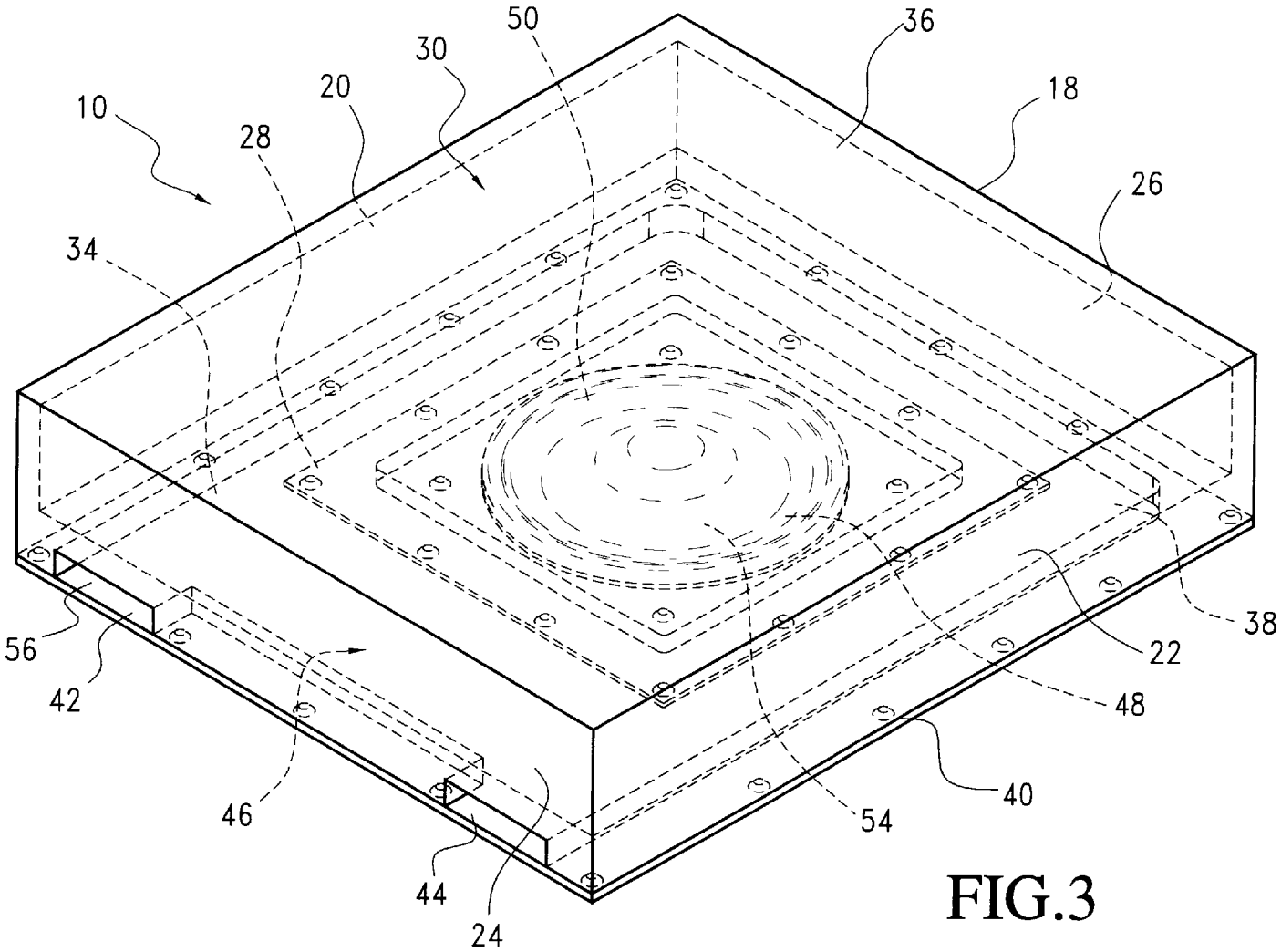
FIG. 3 is a perspective view of the present subwoofer module configured for mounting in a vertical orientation.
Figure 4:
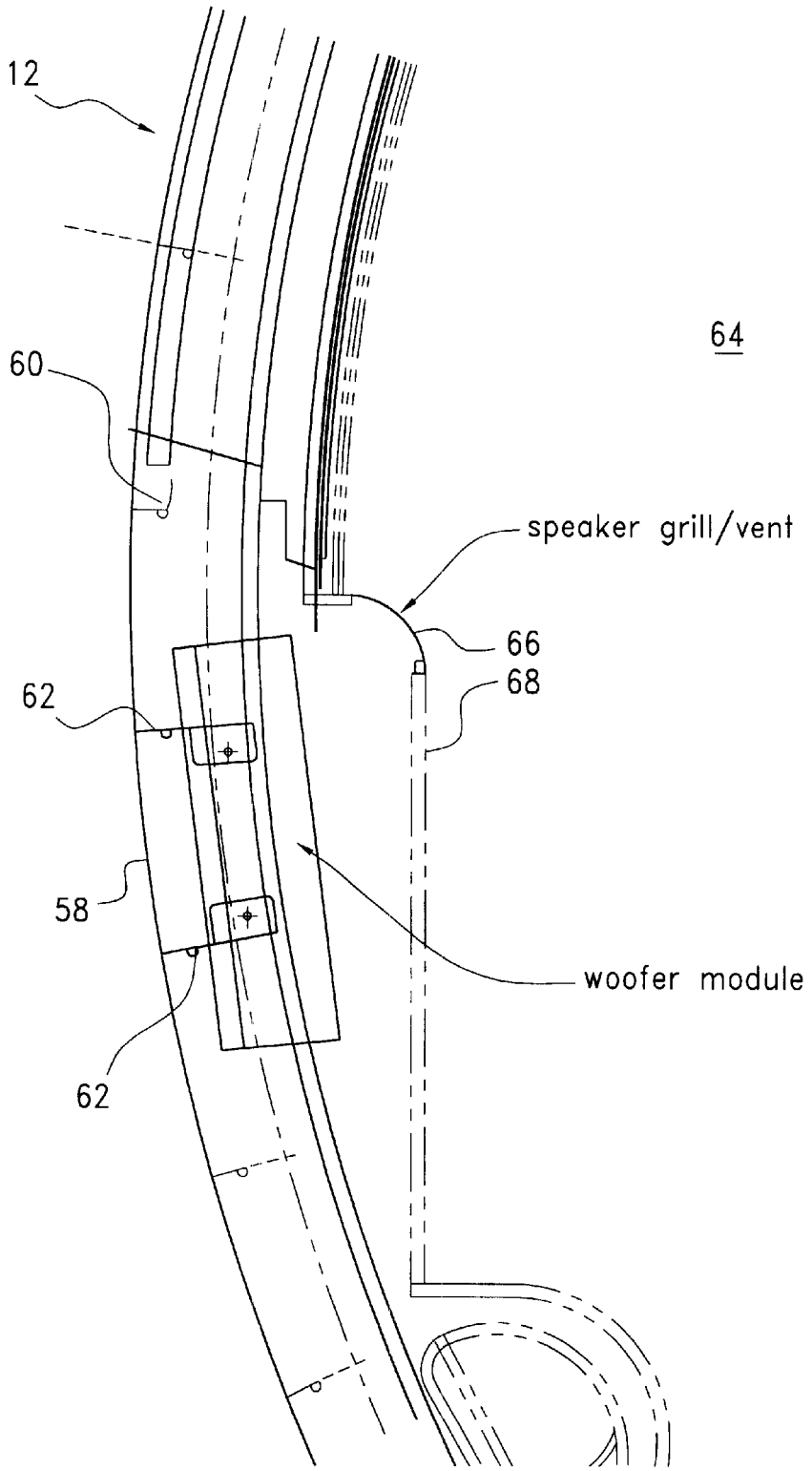
FIG. 4 is a partial cross sectional view of the present subwoofer module mounted within the fuselage wall.

With this in mind, and particularly with reference to FIG. 3, the present subwoofer module 10 is provided with an auxiliary side plate 56 shaped and dimensioned to cover the two slots 42, 44 formed along the front side wall 24. The side plate 56 is secured to the exterior of the front side wall 24 using standard bonding techniques known to those skilled in the art. For example, adhesive may be used, although other bonding techniques known to those skilled in the art may be employed without departing from the spirit of the invention.

Once the auxiliary side plate 56 is properly secured to cover the two slots 42, 44, the subwoofer module 10 may be vertically mounted as desired. For example, and with reference to FIG. 4, the subwoofer module 10 is mounted between adjacent windows and the interior of the wall 58 defining the fuselage 60. The subwoofer module 10 is secured to the fuselage 60 by a plurality of mounting brackets 62 secured between the subwoofer housing 18 and the fuselage 60. The subwoofer module 10 is supported such that the lower compartment 32 faces the fuselage wall 58, while the upper compartment 30 faces the passenger compartment 64. In this way, forced air and waves radiate between the space separating the bottom 40 of the housing 18 from the wall 58 of the fuselage 60, and out a speaker grill or vent 66 formed in the passenger compartment wall 68.

The resulting subwoofer module 10 is wired in a conventional manner, which those skilled in the art will readily appreciate. As such, variations in wiring are contemplated in accordance with the spirit of the present invention.

It should be appreciated that the concepts surrounding the present invention may be applied in various applications without departing from the spirit of the present invention. As such, the dimensions of the subwoofer module may be varied to suit specific applications in accordance with the spirit of the present invention.

In practice, multiple subwoofers are commonly mounted within an aircraft. The number of subwoofers employed is determined by the size of the aircraft and the needs of the aircraft owners. Those of ordinary skill in the art will certainly appreciate the need for specific positioning of the subwoofers within the aircraft to optimize the generated sound.

While the preferred embodiments have been shown and described, it will be understood that there is no intent to limit the invention by such disclosure, but rather, it is intended to cover all modifications and alternate constructions falling within the spirit and scope of the invention.

What is claimed is:

1. A loudspeaker assembly, comprising:

a housing constructed from a material which resonates to transmit sound from within the housing, the housing includes a central driver mounting plate upon which a driver is mounted, the central driver mounting plate and the driver divide the housing into an upper compartment and a lower compartment, the housing further includes a cover plate, a plurality of side walls extending therefrom to form an enclosure and an open end opposite the cover plate, wherein the lower compartment is defined by the central driver mounting plate, the plurality of side walls and the open end of the enclosure, and the upper compartment is fully closed off and defined by the cover plate, the plurality of side walls and the central driver mounting plate; and wherein the lower compartment includes at least one slot formed in one of the plurality of side walls providing fluid communication between an interior of the lower compartment and an external environment.

2. The loudspeaker assembly according to claim 1, wherein the housing is made of aluminum.

3. The loudspeaker assembly according to claim 2, wherein the housing is made of aluminum honeycomb sheet material.

4. The loudspeaker assembly according to claim 3, wherein the aluminum honeycomb sheet material has a thickness of approximately ¼ inch.

5. The loudspeaker assembly according to claim 1, wherein the driver is a low frequency driver.

6. The loudspeaker assembly according to claim 5, wherein the housing is made of a material which will resonate to transmit sound from within the housing.

7. The loudspeaker assembly according to claim 6, wherein the housing is made of aluminum.

8. The loudspeaker assembly according to claim 7, wherein the housing is made of aluminum honeycomb sheet material.

9. The loudspeaker assembly according to claim 8, wherein the aluminum honeycomb sheet material has a thickness of approximately ¼ inch.

10. The loudspeaker assembly according to claim 5, wherein the driver is positioned to fire into the lower compartment of the housing with a convex portion of the driver extending into the upper compartment of the housing.

11. A subwoofer module, comprising:

a housing constructed from a material which resonates to transmit sound from within the housing, the housing includes a central driver mounting plate upon which a low frequency driver is mounted, the central driver mounting plate and the low frequency driver divide the housing into an upper compartment and a lower compartment, the housing further includes a cover plate, a plurality of side walls extending therefrom to form an enclosure and an open end opposite the cover plate, wherein the lower compartment is defined by the central driver mounting plate, the plurality of side walls and the open end of the enclosure, and the upper compartment is fully closed off and defined by the cover plate, the plurality of side walls and the central driver mounting plate; and wherein the lower compartment includes at least one slot formed in one of the plurality of side walls providing fluid communication between an interior of the lower compartment and an external environment.

12. The subwoofer module according to claim 11, wherein the housing is made of aluminum.

13. The subwoofer module according to claim 12, wherein the housing is made of aluminum honeycomb sheet material.

14. The subwoofer module according to claim 11, wherein the low frequency driver is positioned to fire into the lower compartment of the housing with a convex portion of the driver extending into the upper compartment of the housing.

* * * * *